US006336248B1

(12) United States Patent
Finkelstein et al.

(10) Patent No.: US 6,336,248 B1
(45) Date of Patent: Jan. 8, 2002

(54) SUSPENSION SYSTEM FOR SLIDING DOOR

(75) Inventors: Burl Finkelstein, Newnan; Thomas A. Thorsen, Moreland; Brett A. Mitchell, Newnan, all of GA (US)

(73) Assignee: Kason Industries, Inc., Shenandoah, GA (US)

( * ) Notice: Subject to any disclaimer, the term of this patent is extended or adjusted under 35 U.S.C. 154(b) by 0 days.

(21) Appl. No.: 09/566,284

(22) Filed: May 5, 2000

(51) Int. Cl.[7] ..... A47H 1/04

(52) U.S. Cl. ..... 16/96 D; 16/87.4 R; 16/94 R; 312/323

(58) Field of Search ..... 16/87.4 R, 87.6 R, 16/94 R, 102, 101, 96 R, 106, 91, 96 D; 312/322, 323; 49/209, 213, 214, 217

(56) References Cited

U.S. PATENT DOCUMENTS

| | | | | | |
|---|---|---|---|---|---|
| 4,476,652 | A | * | 10/1984 | Beauchot | 16/106 |
| 4,503,638 | A | * | 3/1985 | Schindehutte | 49/213 |
| 4,651,469 | A | * | 3/1987 | Ngian et al. | 49/217 |
| 5,253,452 | A | * | 10/1993 | Goldbach | 49/213 |
| 5,967,595 | A | * | 10/1999 | Heya et al. | 49/213 |

* cited by examiner

*Primary Examiner*—Lynne H. Browne
*Assistant Examiner*—Aaron M Dunwoody
(74) *Attorney, Agent, or Firm*—Baker, Donelson, Bearman & Caldwell

(57) ABSTRACT

A suspension system for a sliding door (15) has an upper support rail (16) from which the door is suspended and a lower guide rail (25) along which the door is guided at a tilt over gaskets (12) that bound the doorway. A spring (40) biases the door (15) to an upright orientation firmly against the gaskets (12) at the door closed position.

9 Claims, 6 Drawing Sheets

SUSPENSION SYSTEM FOR SLIDING DOOR

TECHNICAL FIELD

This invention relates to suspension systems for sliding doors and particularly to suspension systems for sliding doors that are used in opening and closing doorways that provide ingress and egress from refrigerated spaces.

BACKGROUND OF THE INVENTION

Today most commercial kitchens, restaurants and supermarkets use swing doors to close and open space access doorways rather than sliding doors. This is primarily due to their lower cost. Swing doors however are ill suited for use in refrigerated spaces such as walk-in coolers since they must swing freely and thus have clearance with the doorway bounding jamb or wall. Such clearance of course permits air to flow between the refrigerated space and ambience beneath the door even though it is closed. Swing doors also require substantial swing space on each side of the wall. In effect this prevents the spaces along the walls from being used as corridors. They also pose the risk of striking people accidently when doors suddenly swing open. Conversely, sliding door systems have been devised that can seal a doorway. These systems have sealing gaskets either on the door jamb or the door. The sliding doors are suspended by systems that have been quite costly and complex. This complexity and cost has been driven by the need for the door to travel laterally over the doorway and yet towards and away from it as it is brought into sealing engagement with the door jamb gaskets.

Their suspension systems have included ramps which drive the door towards and away from the doorway and adjacent wall in sealing it. They have also included floor mounted guides which typically have had to be mounted atop or inset in concrete. These have been obstacles that have been hazardous to kitchen workers who often carry heavily loaded trays through the doorway. Floor mounted tracks also collect dirt and grime which is unsanitary. Their trolley systems have been complex with numerous parts as shown, for example, in U.S. Pat. No. 4,651,469. This type system is prevalent in Europe where it is known as the Fermod system. Swing doors, especially in smaller man access sizes, cannot readily be replaced with them, or retrofitted, because of their high cost, complexity and need for floor mounted guides and tracks. With larger sizes the high cost of conventional sliding doors is simply accepted as a necessity since a swing door could take up a whole room. They also require auxiliary jambs or sub-frames to support the weight of their suspension system. They also typically have a bulky industrial appearance.

Accordingly, it is seen that a need exists for a sliding door suspension system of simpler and less expensive structure that can be used effectively in opening and sealing a doorway such as one to a refrigerated space. It is to the provision of such that the present invention is primarily directed.

SUMMARY OF THE INVENTION

In a preferred form of the invention, a suspension system is provided for a sliding door that closes a doorway in a wall that is bounded by sealing gaskets. It is of relatively simple and light weight construction so that it can be mounted directly to the wall without the need for a sub-frame. The suspension system has an upper support rail from which the door is suspended by hangers and a lower guide rail along which the door is guided. The two rails are spaced from the wall at distances to have the door slide at a tilted angle over and out of contact with the sealing gaskets except at a doorway closed, sealing position where a spring biases the door firmly against the gaskets. By attaching the hangers inboard of the center of mass of the door, the weight of the door assists in effecting a good seal.

BRIEF DESCRIPTION OF THE DRAWING

FIG. 8A is a top view showing the guide mechanism about to reach an end portion of the lower guide rail while

DETAILED DESCRIPTION

Figure 1:
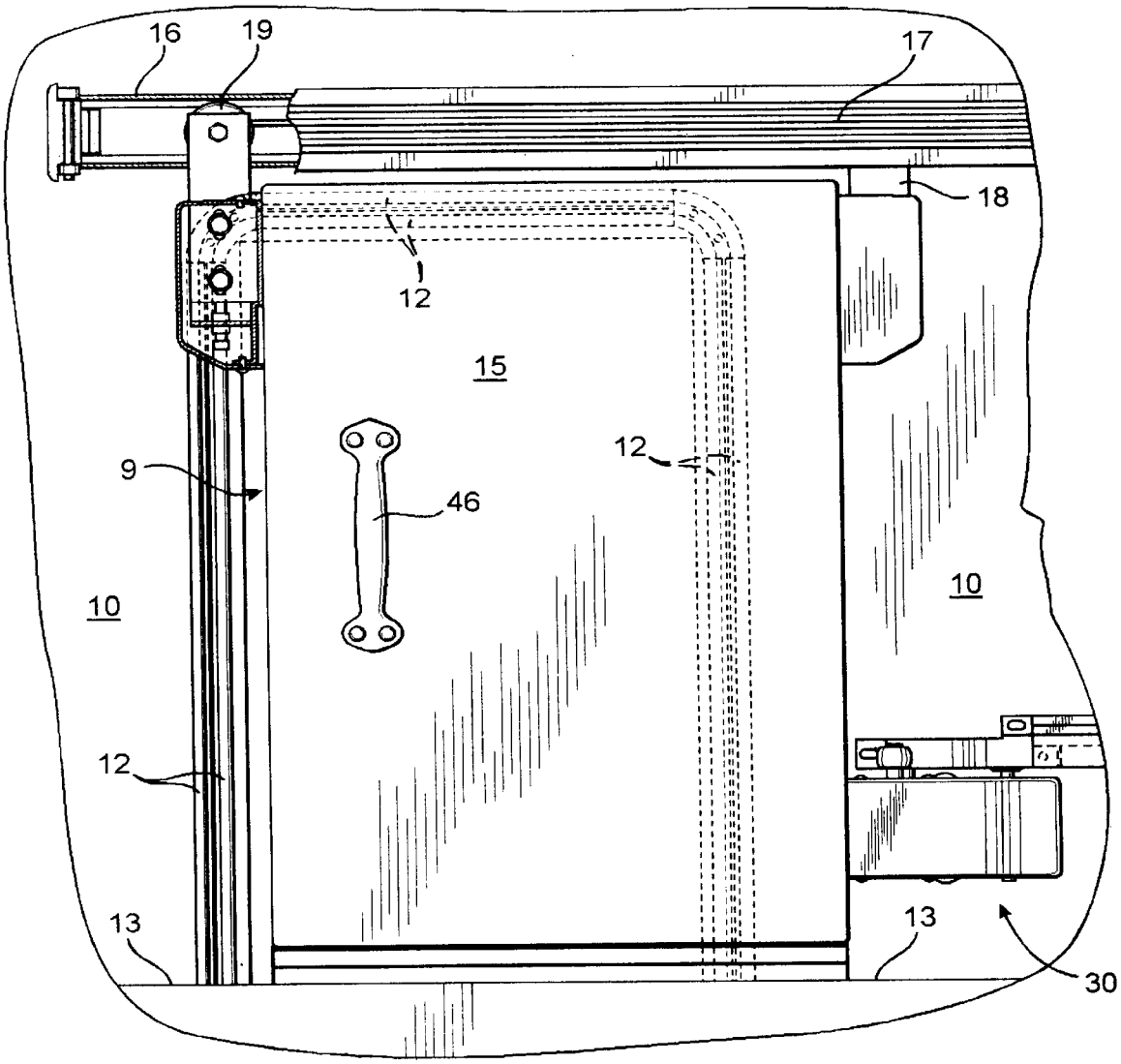
FIG. 1 is a front view of a sliding door that is mounted with a suspension system that embodies principles of the invention in its preferred form.

With reference next in more detail to the drawing, there is shown in FIG. 1 a wall 10 having a doorway 9 that is bounded along its top and sides by resilient sealing gaskets 12. The wall and doorway extended upwardly from a floor 13 such as one made of concrete. A sliding door 15 with handle 46 is mounted to the wall 10 for sliding movement between a closed position sealing the doorway closed and a doorway open position. Typically the doorway provides for access to a refrigerated space such as a commercial walk-in cooler.

Figure 2:
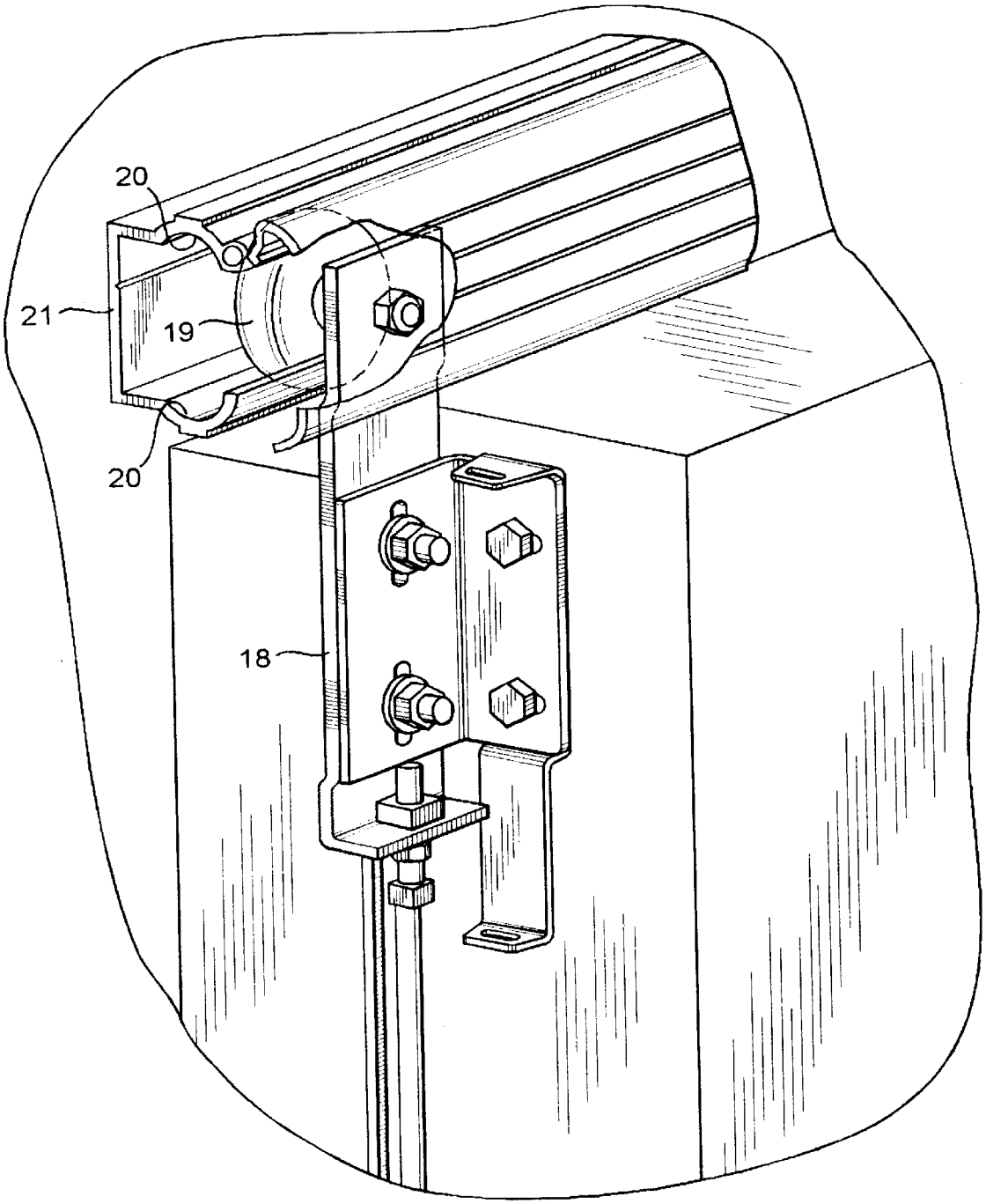
FIG. 2 is a perspective view of one of the door hangers with a hanger roller riding along an upper support rail, shown with the covers removed.

The door is mounted by a suspension system that includes an upper support rail 16 that is covered by a cover 17. The upper support rail is mounted to the wall over and to each side of the doorway 9. The door 15 is movably suspended from the rail by means of two hangers 18 to which a hanger roller 19 is journaled. As shown in FIG. 2 the roller 19 has a curved bearing surface and travels along upper and lower curved bearing surfaces 20 of the upper support rail. These surfaces 20 are slightly wider than the curved bearing surfaces of the roller which permit the rollers to cock or tilt slightly as they it ride the rails. The center line of the rail bearing surface 20 is spaced from the wall mounted surface 21 at a selected distance. Adjustment means is provided to enable the door to be mounted at various heights.

Figure 8A:
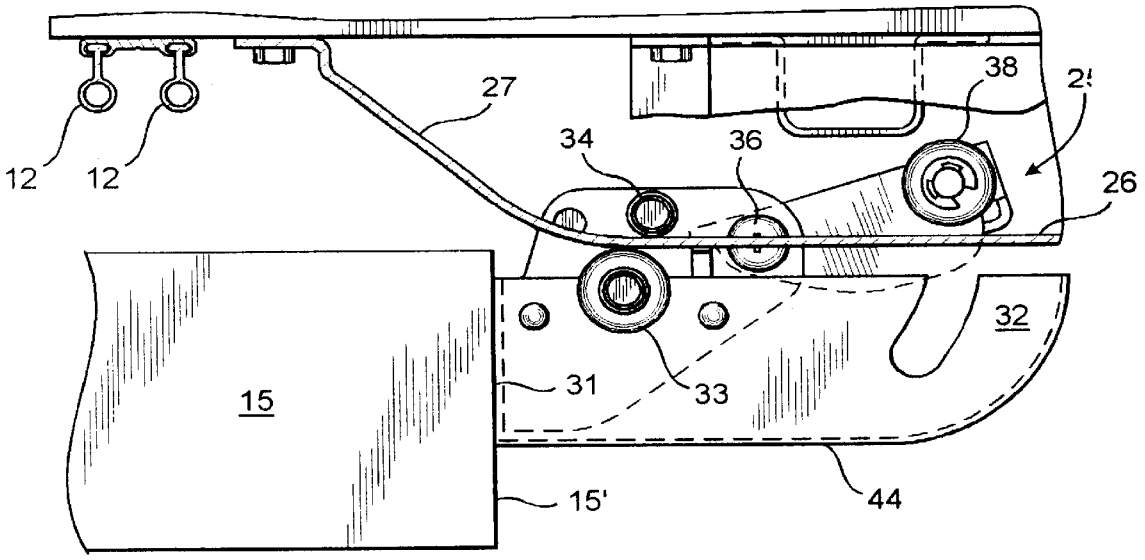
Figure 8B:
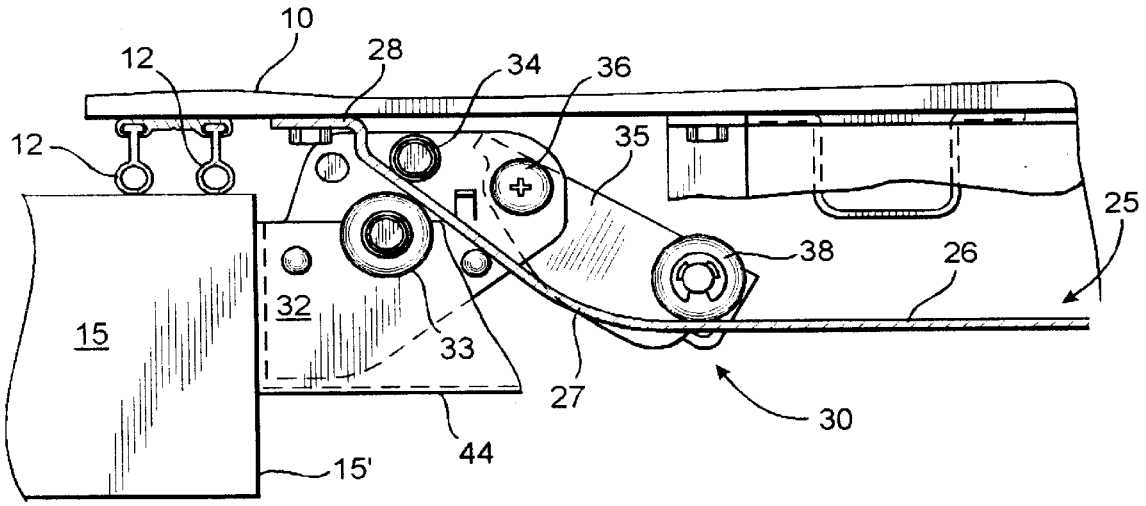
FIG. 8B shows the mechanism at the end portion with the door in sealing engagement with the doorway gaskets.

With continued reference to the drawing the sliding door suspension system is further seen to include a lower guide rail 25. As best shown in FIGS. 8A and 8B, the guide rail 25 has a long, linear portion 26 that merges with an inturned, end portion 27 that has a mounted flange 28 bolted to the wall 10. The upright rail linear portion is mounted parallel with the wall 10 with its inside bearing surface that faces the wall being located a distance from the wall with respect to the selected distance that the centerline of the bearing surface of the upper rail is so mounted to cause the door to move at a tilt along the linear portion as shown in FIG. 3 and is hereinafter further explained.

The door is guided along the lower guide rail by a guide mechanism 30 that is shown in FIGS. 4–8. The mechanism is mounted to the edge 15' of the door 15 by mounting a flange 31 of a bracket 32 flush thereto. A guide roller 33 and a guide pin 34 are rotatably mounted atop the bracket. A U-shaped swing arm 35 is pivotal mounted to the bracket by pivot pins 36. The swing arm carried a push roller 38. One end of a spring 40 is mounted to the push roller axle 39. The other end of the spring is mounted to a mounting pin 42 that is mounted to the bracket 32. The pin 42 is located relative to the roller axle 39 and swing arm pivot pin 36 such that rotation of the swing arm can cause the spring to become over centered and bias the push roller 38 and the swing arm to which it is mounted. The mechanism is mounted to the lower guide rail 26 so that the roller and pin straddle it with the push roller 38 in contact with the inside face of the rail it as shown best in FIGS. 8A and 8B. The mechanism is covered by a cover 44.

Figure 3:
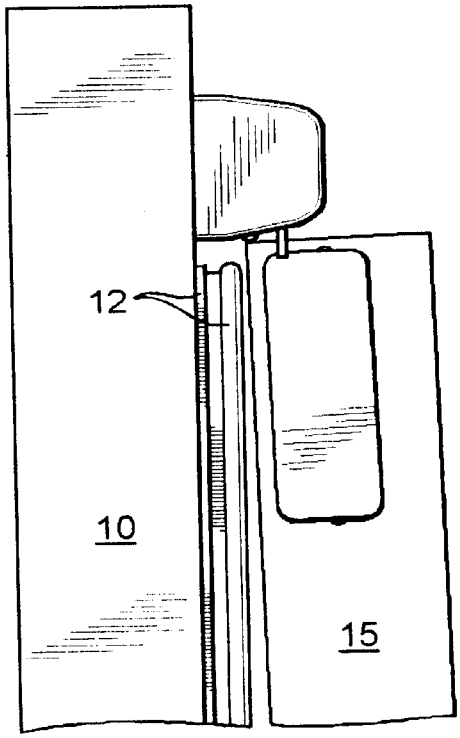
FIG. 3 is an end view of the door showing how it travels at a tilt over the doorway gaskets.
Figure 3:
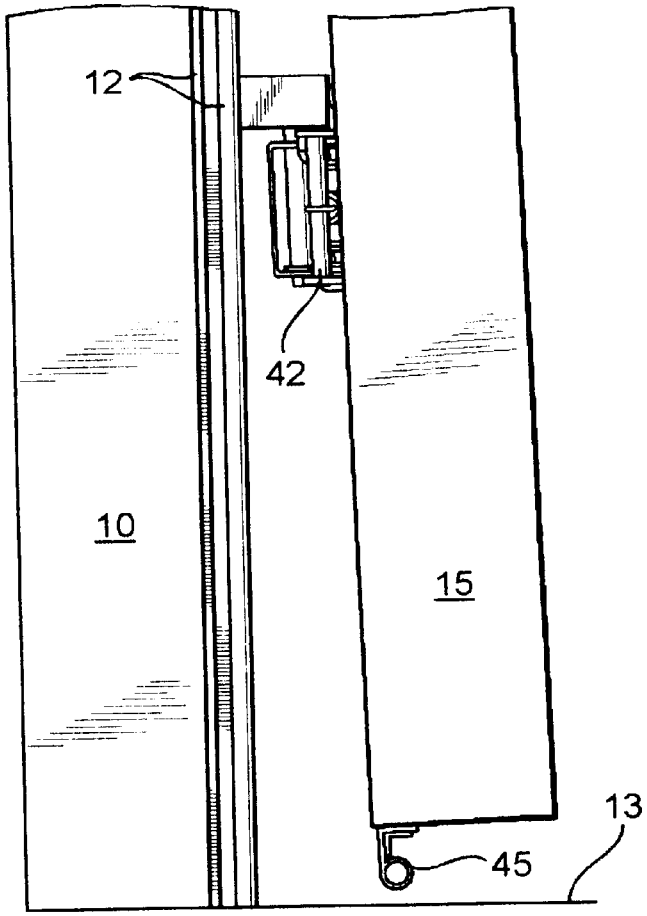
Figure 4:
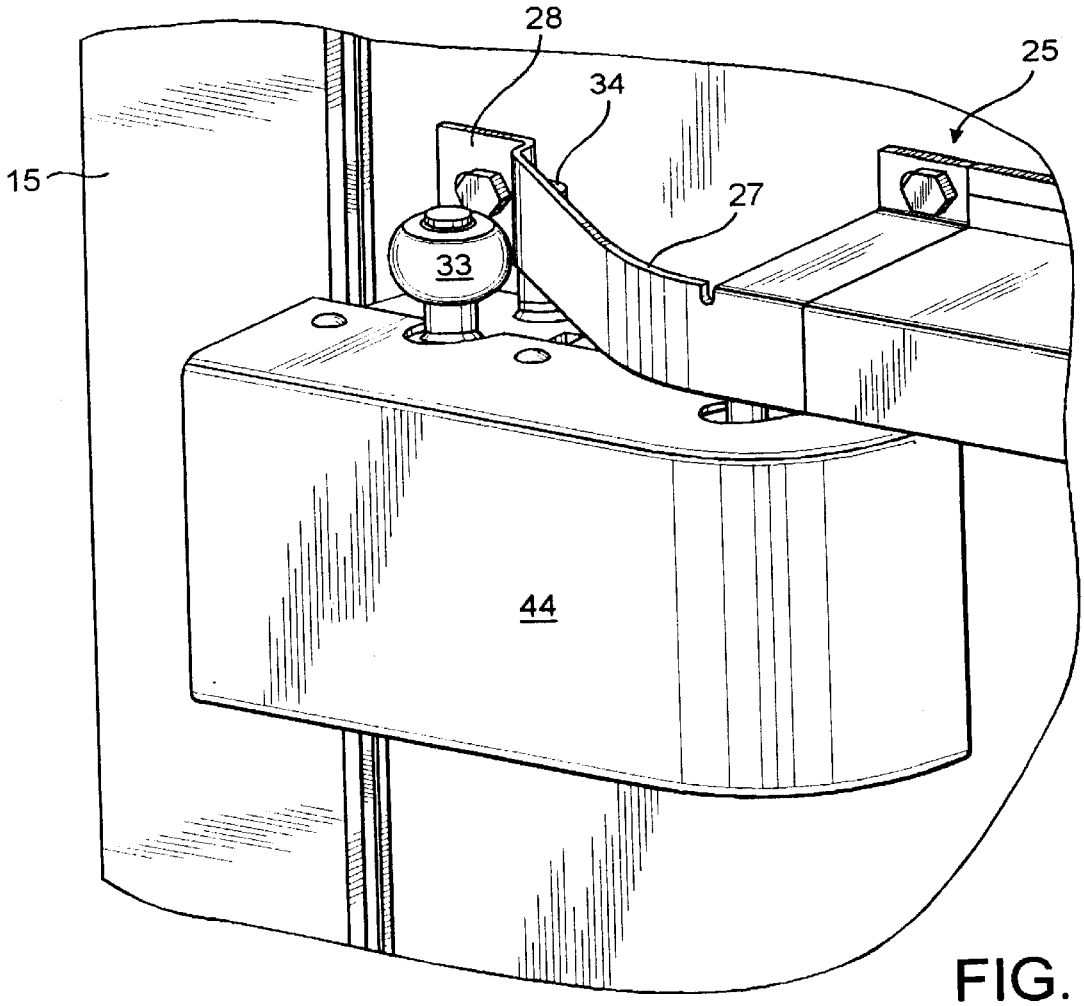
FIG. 4 is a perspective view of a system guide mechanism that is mounted to the door in engagement with the lower guide rail.
Figure 7:
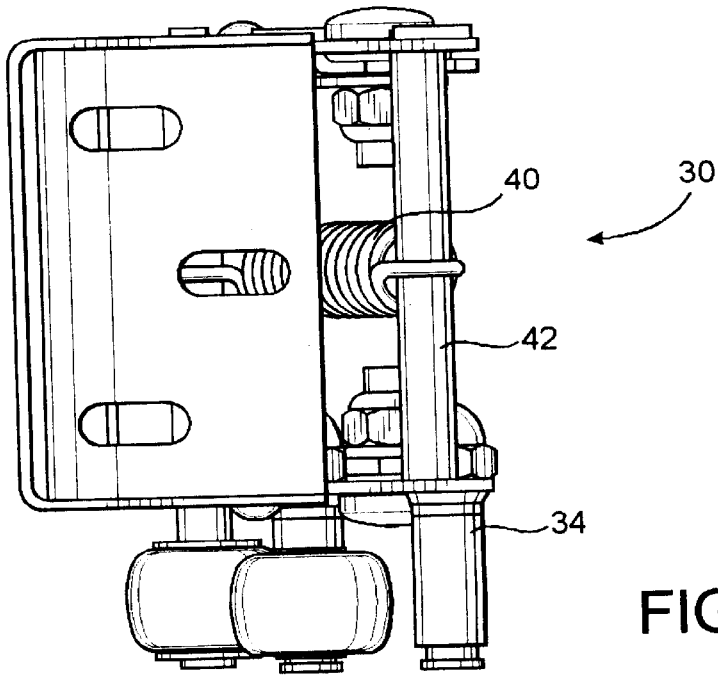
FIG. 7 is an inverted end view of the guide mechanism of FIG. 4.
Figure 5:
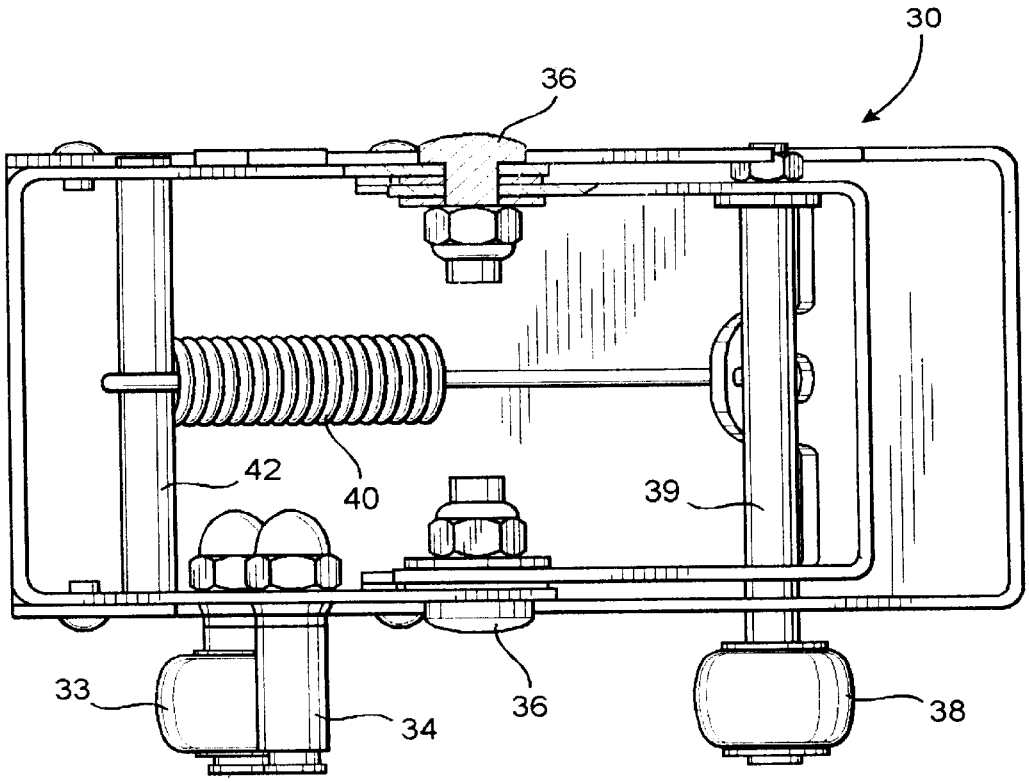
FIG. 5 is an inverted rear view of the guide mechanism of FIG. 4.

Once mounted with the just described suspension system the door 15 may travel along the linear portion of the lower guide rail 27, suspended from the upper support rail 16 with its bottom tilted away from the wall 10 as shown in FIG. 3. Thus the plane of the door geometrically intersects the plane of the wall face and of the gaskets above them. As it travels in this orientation it is seen not to engage the doorway gaskets 12 by means of the relative location of the upper and lower rails. Also, a bottom gasket 45 on the bottom of the door is raised off the floor. Thus the door can glide easily unencumbered by gasket friction. Also the push roller 38 rolls free of the guide or in slightly rolling contact with it as shown in FIG. 8A. The roller 33 and pin 34 maintain the rigid door in its tilted position since they straddle the rail 25.

Figure 6:
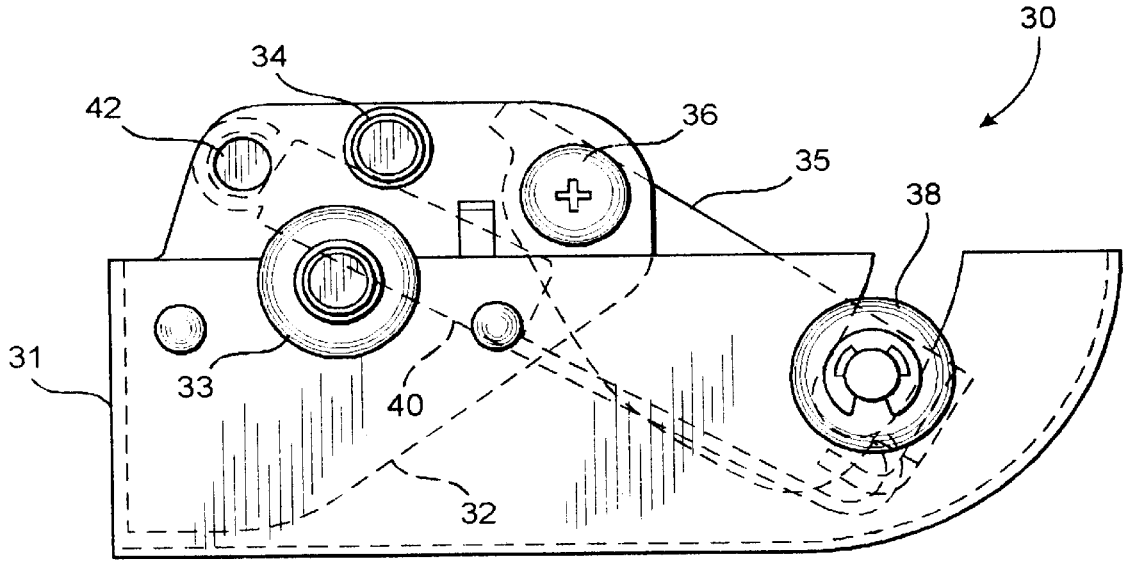
FIG. 6 is a top view of the guide mechanism of FIG. 4.

As the door approaches its closed position the roller 33 and pin 34 move off of the long linear position of the lower rail 26 and onto its inturned end portion 27. This in turn causes the lower portion of the door to move towards the wall 10 and the angle of door tilt to decrease. Movement of the bracket 32 towards the wall also occurs as shown in FIG. 8B. The spring 40 is brought to an over centered position as shown in FIG. 6 which causes it to bias the push roller 38 away from the wall 10 and against the rail 26. As the door becomes upright its bottom gasket is also swung into engagement with the floor at the doorway. In this manner the doorway may become sealing closed virtually airtight.

It thus is seen that a suspension system is now provided for a sliding door that enables the door to be easily moved to and from an open position and yet which provides for a firm closing of a doorway. Where the doorway is bounded by sealing gaskets which is commonly for accesses to refrigerated spaces, the door may be slid open and closed without contact with the gaskets. Yet when the door is moved to a doorway closing position it is brought into firm sealing engagement with the gaskets.

Though the suspension system is principally designed for a door and doorway with peripheral sealing gaskets, it is useful too for doorways without such gaskets or for situations where sealing gaskets are mounted to the door instead. It can be mounted directly to a wall or wall panels since it is of such simple and lightweight construction. It presents a low profile appearance rendering it suitable for kitchen use.

While the system has been shown and described in its preferred form, it should be understood that many modifications, additions and deletions may be made thereto without departure from the spirit and scope of the invention as set forth in the following claims.

What is claimed is:

1. A suspension system for a sliding door comprising an upper support rail adapted to be mounted over and to a side of a doorway at least partially bounded with peripheral sealing gaskets; means for movable suspending a door from said upper support rail; a lower guide rail adapted to be mounted aside a lower portion of the doorway and which has a linear portion that merges with an inturned end portion; and a guide mechanism adapted to be mounted to a lower portion of the door that has at least two guide rollers that straddle said lower guide rail and that has spring means for spring biasing the door against the doorway peripheral sealing gaskets as the two guide rollers roll over the lower guide rail inturned end portion.

2. The suspension system of claim 1 wherein said guide mechanism comprises a bracket adapted to be rigidly mounted to the door, a swing arm pivotably mounted to said bracket, a push roller mounted to said swing arm for rolling engagement with the inside of said lower rail, and a spring mounted to said bracket and roller whereby as the door approaches its closed position and the two guide rollers move from the lower rail linear portion onto the inturned end portion the spring becomes over centered and biases the push roller against the rail thereby pushing the door against the gaskets.

3. The suspension system of claim 1 for a doorway with peripheral sealing gaskets being substantially in a plane, and wherein said support guide rail and said lower guide rail linear portions are adapted to be mounted in a plane that intersects said gaskets plane over the doorway whereby the door is tilted as it slides along the rails.

4. The suspension system of claim 3 further comprising two door hangers to each of which a support roller is rotatably mounted, and wherein said upper support rail has a curved groove in which said support rollers may ride and become cocked when the door is tilted.

5. The suspension system of claim 4 wherein said upper support rail has a wall mounting surface located at a selected distance from said groove, and wherein said lower guide rail linear portion has an inside bearing surface and a wall mounting surface located at a distance from said bearing surface to said selected distance such that the door is tilted away from and out of contact with the gaskets as it travels over them.

6. A suspension system for a door that slides over a doorway and which comprises an upper support rail from which the door may be suspended, a lower guide rail having a linear portion that merges with an inturned end portion against which the door may be guided at a tilted angle as it slides over the doorway against the linear portion and guided to an untilted angle as it closes the doorway as it slides against the inturned end portion, a bracket adapted to be mounted to the door, a fixed guide roller mounted to said bracket, a swing arm mounted to said bracket at a pivot, a push roller mounted to said swing arm to one side of said pivot, and a spring mounted to said push roller and to said bracket to the other side of said pivot whereby the spring becomes over centered and biases the push roller against the lower rail as the guide roller rolls from the lower said linear portion onto the lower said inturned end portion.

7. A sliding door system for closing and opening a doorway in a wall that is bounded by sealing gaskets and which comprises an upper support rail mounted to the wall over the doorway that has an elongated bearing surface, a door suspended from said support rail, a lower guide rail mounted to the wall beside the doorway that has an inside bearing surface, two hangers mounted to said door each of which bears a roller that travels on said upper support rail, and a push roller mounted to said door in rolling contact with the side of said lower guide rail adjacent the wall, and wherein said bearing surfaces of said upper and lower rails are located at distances from the wall such that the door slides at a tilt out of contact with the gaskets as it is moved towards and away from a position closing the doorway.

8. The sliding door of claim 7 further comprising spring means for adjustably biasing the door against the gaskets in a doorway closed position.

9. A method of opening and closing a doorway in a substantially vertical wall that is a least partially bound by sealing gaskets which comprises the steps of sliding a door at a tilted angle over the gaskets in opening and closing the doorway and drawing the door into and out of an untilted position firmly against the sealing gaskets in sealing the doorway closed.

* * * * *